US006121945A

United States Patent [19]

Tanaka et al.

[11] Patent Number: 6,121,945

[45] **Date of Patent: *Sep. 19, 2000**

[54] LIQUID CRYSTAL DISPLAY DEVICE

[75] Inventors: Toshihiko Tanaka, Tottori; Makoto Kasami, Tottori-ken; Kouji Maeta, Tottori; Norimitsu Kobayashi, Tottori; Shoji Iwasaki, Tottori; Jouji Yamada, Tottori; Akinori Matsushita, Tottori, all of Japan

[73] Assignees: Sanyo Electric Co., Ltd., Osaka-Fu; Tottori Sanyo Electric Co., Ltd., Tottori-ken, both of Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/694,355

[22] Filed: Aug. 8, 1996

[30] Foreign Application Priority Data

Aug. 9, 1995 [JP] Japan ..... 7-203465
Dec. 19, 1995 [JP] Japan ..... 7-330578

[51] Int. Cl.[7] ..... G09G 3/34

[52] U.S. Cl. ..... 345/94

[58] Field of Search ..... 345/209, 210, 345/211, 212, 96, 100, 94, 95; 348/760, 792

[56] References Cited

U.S. PATENT DOCUMENTS

| | | | |
|---|---|---|---|
| 5,323,171 | 6/1994 | Yokouchi et al. | 345/94 |
| 5,404,150 | 4/1995 | Murata . | |
| 5,619,221 | 4/1997 | Hirai et al. | 345/58 |

FOREIGN PATENT DOCUMENTS

| | | |
|---|---|---|
| 0 395 387A | 10/1990 | European Pat. Off. . |
| 34 04 452A | 8/1984 | Germany . |
| 57-15393 | 3/1982 | Japan . |
| 57-38497 | 3/1982 | Japan . |
| 57-57718 | 12/1982 | Japan . |
| 61-41190 | 2/1986 | Japan . |
| 63-304228 | 12/1988 | Japan . |
| 3-2394 | 1/1991 | Japan . |
| 4-97218 | 3/1992 | Japan . |
| 5-35217 | 2/1993 | Japan . |
| 6-26890 | 7/1994 | Japan . |

OTHER PUBLICATIONS

Williams, M., "Practical 5–Level LCD Multiplexing", 8080 Wescon Conference Record, vol. 24, pp. 1–8, Sep. 16–18, 1980.

*Primary Examiner*—Amare Mengistu
*Attorney, Agent, or Firm*—McDermott, Will & Emery

[57] ABSTRACT

A simple matrix drive type liquid crystal display device with enhanced display quality is provided. In line-at-a-time scanning, a scanning electrode group is supplied with two selecting voltages alternately; a signal electrode group is supplied with two voltages close to the intermediate value between the two selecting voltages. Which voltage is applied to the signal electrode is determined in accordance with the selecting voltage applied to the scanning electrode at that moment and a video signal in such a way that selected picture elements receive a large voltage and non-selected picture elements receive a small voltage. The output voltage of the power source circuit, which supplies power to the scanning circuit and the signal circuit that apply voltages to the scanning and signal electrode groups, is monitored so that, if the voltage is below a predetermined value, the liquid display device will not start display even when it receives a signal requesting starting of display from the outside.

2 Claims, 8 Drawing Sheets

FIG. 8A (PRIOR ART)
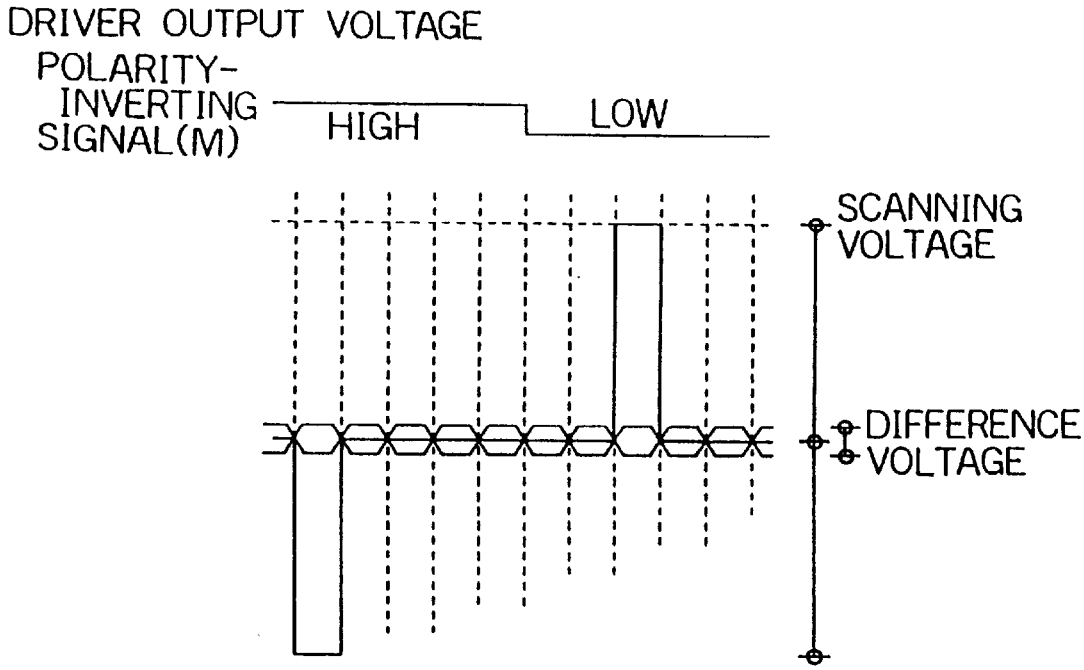
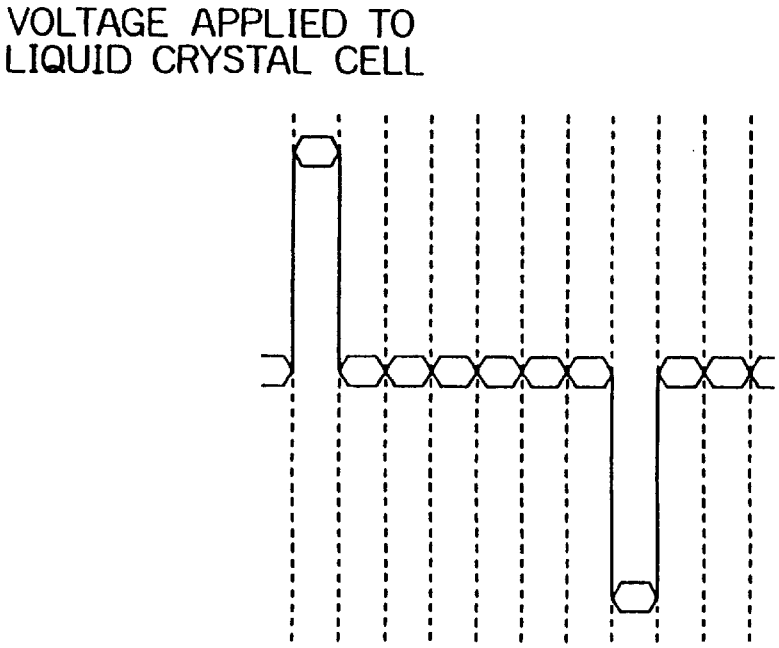
FIG. 8B (PRIOR ART)

LIQUID CRYSTAL DISPLAY DEVICE

BACKGROUND OF THE INVENTION

1. Field of the Invention

The present invention relates to a liquid crystal display device of the simple matrix drive type, and particularly to a liquid crystal display device which inverts the polarity of the scanning voltage by applying positive and negative selecting voltages alternately to its scanning electrode group in order to achieve line-at-a-time scanning.

2. Description of the Prior Art

Conventionally, the so-called simple matrix driving of a liquid crystal cell, such as is provided with electrode groups arranged perpendicularly to each other on both sides of a liquid crystal layer, has been achieved by line-at-a-time scanning. Specifically, the electrodes of one electrode group is sequentially supplied with a high-level voltage, and, while the high-level voltage is being applied to one electrode, the other electrode group is supplied with voltages in accordance with the video signal. Meanwhile, to avoid applying a direct-current to the liquid crystal, it has been customary to invert the polarity of those voltages, as disclosed in Japanese Published Patent Application S57-57718.

Take for example a method which accomplishes alternating-current driving by providing an polarity-inverting signal that inverts its polarity frame by frame. According to this method, while the first frame is being scanned, the scanning electrodes are supplied with a voltage V0, and the signal electrodes for the picture elements to be displayed (selected picture elements) are supplied with a voltage V1 for the first frame; then, while the next frame is being scanned, the scanning electrodes are supplied with the voltage V1, and the signal electrodes are supplied with the voltage V0.

This method, however, results in increase of power consumption, because the liquid crystal causes a large capacitive load current to flow when the polarity-inverting signal switches its polarity. Moveover, the latest developments have made it possible to produce liquid crystal display devices with as many as 1,024 RGB×768 picture elements (color XGA, with 3,072 signal-side picture elements per line), as compared to conventionally common ones with 640×480 picture elements (VGA). Since these larger devices require accordingly higher speeds in data transfer and other processing, they necessitate integrated circuits that are capable of handling higher voltages at higher speeds. Attempts to realize such integrated circuits, however, have been unsuccessful to date, because, in integrated circuits, higher processing speeds usually conflict with their handling of higher voltages.

Trying to solve these problems, the applicant of the present application proposed, in U.S. patent application Ser. No. 08/553,868, a liquid crystal display device that satisfies the conflicting requirements as described above. In this display device, a large-value positive voltage, a large-value negative voltage and an intermediate voltage between the large-value positive and negative voltages are applied to the scanning electrode group, and two difference voltages close to the intermediate voltage are applied to the signal electrode group.

The large-value voltages are selecting voltages to select picture elements to be displayed, and the positive and negative voltages are alternately applied every scanning to invert the polarity. To the scanning electrodes other than the scanning electrode to which the selecting voltage is being applied is supplied with the intermediate voltage. Which one among the two difference voltages is applied to the signal electrodes is determined based on the polarity of the selecting voltage being applied and on the video signal. When the picture element at the intersection of a signal electrode and the scanning electrode to which the selecting voltage is being applied is to be displayed, the voltage which causes larger potential difference between the scanning and signal electrodes is supplied to that signal electrode.

The voltages applied in the above-mentioned liquid crystal display device are shown in FIGS. 8A and 8B. FIG. 8A shows output voltages of a scanning circuit which supplies voltages to the scanning electrodes and a signal circuit which supplies voltages to the signal electrodes, and FIG. 8A shows voltages applied to the liquid crystal. These figures show that the scanning voltage results from selecting either the positive or negative selecting voltage at constant time intervals; however, since which of the difference voltages outputted from the signal circuit is selected changes according as the video signal and the polarity-inverting signal change, the voltages in both cases are simultaneously shown in the figures, making the diagrams look like, as it were, beads in an abacus. This does not indicate, however, that both signal voltages may be selected at the same time just as shown in the figure, nor that the voltage waveforms change gradually.

This liquid crystal display device, however, has proved to cause ghosts as described in Japanese Published Utility Model Application H6-26890. Specifically, in a dot matrix display device with a large number of picture elements, when vertical or horizontal bars or boxes of fixed widths such as are found in a bar graph or the like are displayed, they are accompanied with dim shadow-like lines or bars appearing in their respective extension directions where picture elements are supposed to be turned off. This greatly degrades picture quality.

The liquid crystal display device has also proved to pose a new problem as follows. Some types of devices that are used in combination with the liquid crystal display device generate a display activating (DISP-OFF) signal, which serves as a display control signal, at approximately the same time as it outputs a frame (FLM) signal and a clock signal. When the liquid crystal display device in question is connected to a device that outputs the DISP-OFF signal earlier than usual as described above, the DISP-OFF signal, which is supplied to the scanning and signal circuits, may turn into an active state (H-level) prematurely, that is, before the bias voltage for driving the liquid crystal, which is generated by a DC—DC converter or other at the start-up of the display-on sequence, reaches a predetermined voltage. This usually results in stripes appearing on the display screen. Furthermore, since the voltage supplied to the liquid crystal rises to the predetermined voltage only after the DISP-OFF signal has turned into the active state, the screen brightens up not immediately but gradually. Therefore, according to this method, degradation of display quality is unavoidable.

Moreover, the DC—DC converter for generating the bias voltage for driving the liquid crystal is controlled in such a way that the bias voltage is generated based on the value of the power source voltage VDD irrespective of the state of the DISP-OFF signal. As a result, for example, when the power source voltage is reduced (e.g. from 5 V to 3 V) and the power source voltage takes accordingly shorter time to fall during the display-off sequence, there remains no sufficient time for the DC—DC converter to drop its output voltage before the fall of the power source voltage VDD.

SUMMARY OF THE INVENTION

An object of the present invention is to improve the display quality of a liquid crystal display device.

To achieve the above object, according to the present invention, a simple matrix liquid crystal display device is provided with a scanning circuit for selecting either a positive or negative selecting voltage to supply it as a scanning voltage to one electrode group of a liquid crystal cell and for supplying thereto an intermediate voltage having approximately an intermediate value between the positive and negative selecting voltages during non-selecting period; a signal circuit for selectively supplying signal voltages close to the intermediate value between the positive and negative selecting voltage to another electrode group of the liquid crystal cell in accordance with a video signal; and a power source circuit for supplying at least the selecting voltages, the signal voltages, and the intermediate voltage compensated for the signal voltage.

Moreover, according to the present invention, while the scanning circuit selects either the positive or negative selecting voltage in accordance with a polarity-inverting signal to supply it as a scanning voltage and the signal circuit selectively supplies signal voltages close to the intermediate value between the positive and negative selecting voltages in accordance with the video signal, the scanning circuit supplies different intermediate voltages close to the intermediate value between the positive and negative selecting voltages to the scanning-side electrode group in accordance with the polarity-inverting signal during a non-selecting period.

Further, according to the present invention, in a liquid crystal display device provided with a liquid crystal cell having electrode groups arranged perpendicularly to each other, a scanning circuit for supplying a scanning voltage to one electrode group of the liquid crystal cell, a signal circuit for supplying a signal voltage to another electrode group of the liquid crystal cell in accordance with a video signal, and a power source circuit for performing voltage conversion to convert a supplied power source voltage into voltages having predetermined bias values and to supply them to the scanning and signal circuits, a conversion circuit is provided for performing signal processing to convert an external display-activating signal supplied as a display control signal from outside into an internal display-activating signal and to supply it to the scanning and signal circuits, the conversion circuit comprising a voltage detection circuit for detecting whether the power source voltage is higher than a predetermined value or not, a delay circuit for outputting a detection signal of the voltage detection circuit with a predetermined delay as the internal display-activating signal, and an initializing circuit for generating an initializing signal to initialize the delay circuit, the initializing circuit generating the initializing signal when the detection signal of the voltage detection circuit and the external display-activating signal are in predetermined states.

The delay circuit is composed of shift registers, an output of its front stage being supplied as a control signal to the circuit for performing the voltage conversion.

BRIEF DESCRIPTION OF THE DRAWINGS

This and other objects and features of this invention will become clear from the following description, taken in conjunction with the preferred embodiments with reference to the accompanied drawings in which:

FIG. 2A shows the output voltages of the scanning and signal circuits, FIG. 2B shows the polarity-inverting signal, and FIG. 2C shows the voltages applied to the liquid crystal;

FIGS. 8(A) and 8(B) are diagrams showing the waveforms of driving signals in a conventional liquid crystal display device, where FIG. 8A shows the output voltages of the scanning and signal circuits, and FIG. 8B shows the voltages applied to the liquid crystal.

DESCRIPTION OF THE PREFERRED EMBODIMENTS

Figure 1:
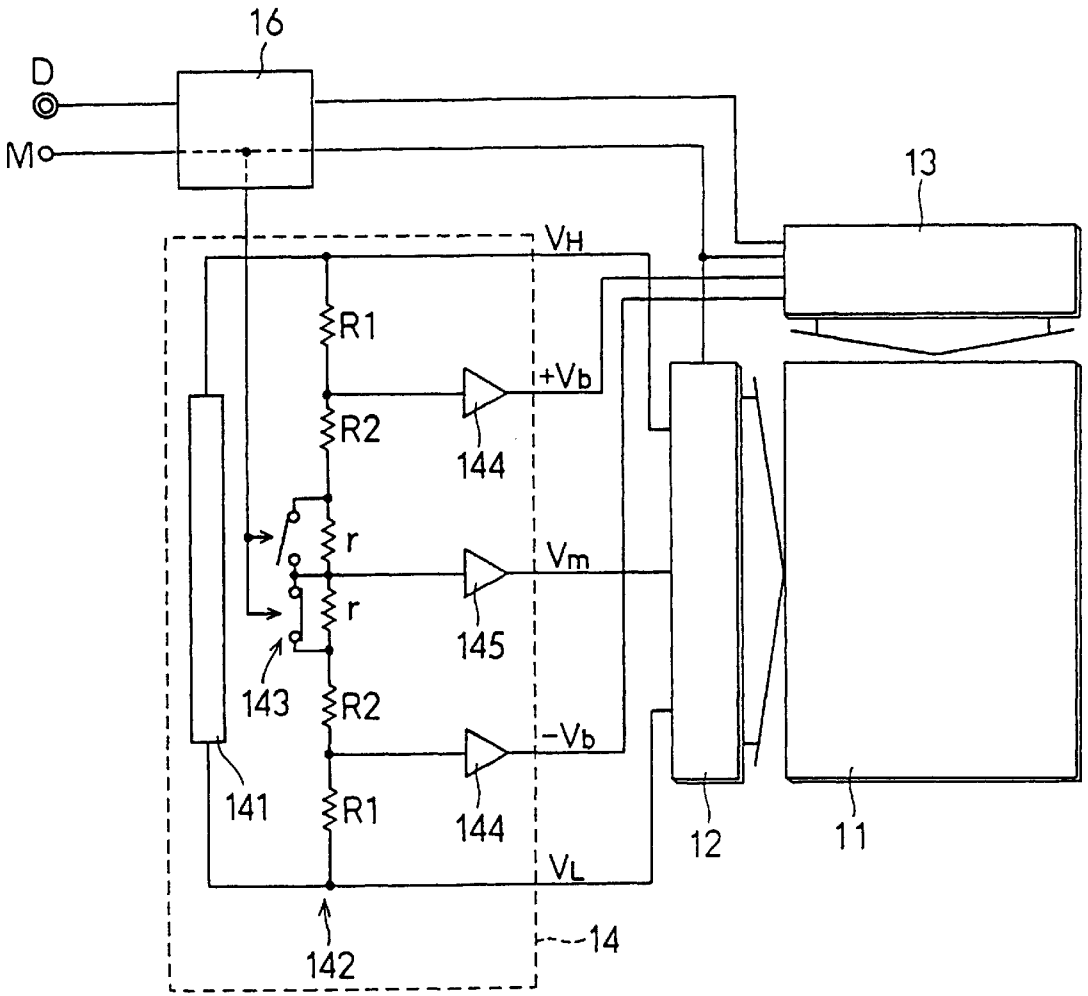
FIG. 1 is a block diagram of a liquid crystal display device of a first embodiment of the present invention.
Figure 2A:
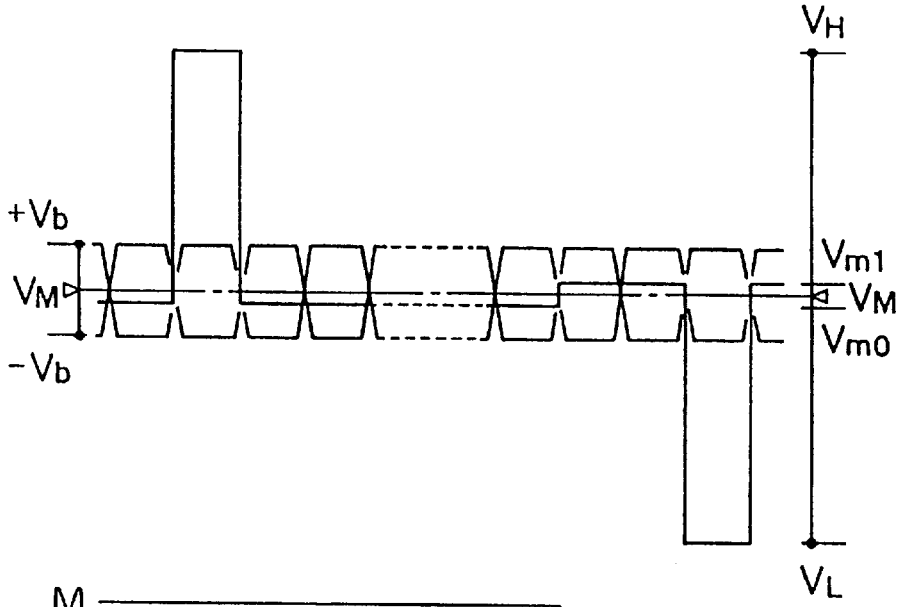
FIGS. 2A, 2B and 2C showing the waveforms of the driving signals of the first embodiment of the present invention, where
Figure 2B:
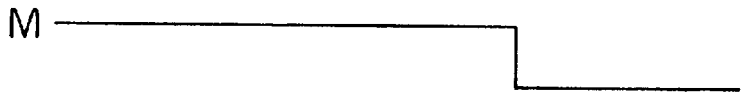
Figure 2C:
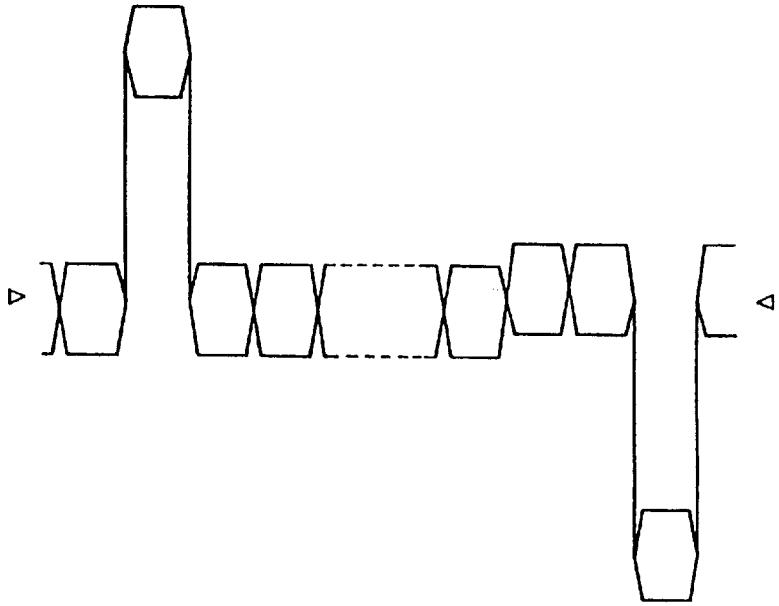

FIG. 1 is a block diagram of a liquid crystal display device of a first embodiment of the present invention. FIGS. 2A to 2C show waveforms of the driving signals in its principal part. In FIG. 1, reference numeral 11 represents a liquid crystal cell provided with electrode groups that are arranged perpendicularly to each other. Used as the liquid crystal cell 11 is, for example, a field-effect-type liquid crystal such as a super-twisted nematic liquid crystal display device. The electrodes of the liquid crystal cell 11 form the so-called simple matrix, which does not have active devices like transistors at the intersections of the electrodes, that is, at the picture elements.

Reference numeral 12 represents a scanning circuit for supplying a scanning voltage to one electrode group of the liquid crystal cell 11; it selects one from among a positive voltage VH, a negative voltage VL, and an intermediate voltage Vm, and supplies it to a specific electrode. Of the three voltages mentioned, VH and VL are the selecting voltages; the intermediate voltage Vm has an approximately intermediate value between the positive and negative selecting voltages, and it is supplied to one electrode group during a non-selecting period when neither of the selecting voltages are selected. As described later, the intermediate voltage Vm actually has, by selection, either a voltage Vm0 or a voltage Vm1, which are each slightly deviated from the actual intermediate value VM between the positive and negative selecting voltages. This scanning circuit selects either the positive or negative selecting voltage in accordance with an polarity-inverting signal M, and supplies the selected voltage as a scanning voltage to a specific electrode.

Reference numeral 13 represents a signal circuit for supplying the other electrode group of the liquid crystal cell 11 with a voltage in accordance with a video signal; more specifically, it supplies those electrodes with either of two types of signal voltages −Vb and +Vb, which are both close to the intermediate value between the positive and negative selecting voltages VH and VL of the scanning circuit 12, in accordance with the video signal D. The video signal D is received through a display signal reception circuit 16 from an external device such as a personal computer together with the polarity-inverting signal M and display control signals.

Reference numeral 14 represents a power supply circuit for supplying voltages having predetermined bias values to the scanning circuit 12 and the signal circuit 13; it provides at least the positive and negative selecting voltages VH and VL, the signal voltages −Vb and +Vb, and the intermediate voltage Vm; more preferably, it also supplies power voltages for driving the scanning circuit 12, the signal circuit 13, and other integrated circuits such as buffers. In the description below, the intermediate voltage Vm is assumed to be produced by generating and outputting either of the intermediate voltage Vm0 or Vm1 that are compensated for the signal voltage; however, it may be produced in other ways, for example, by internally generating both the above-mentioned Vm0 and Vm1 and selecting either for output, or by generating the two intermediate voltages in the power supply circuit 14 and selecting either in the scanning circuit 12 or in a separately provided selecting circuit; alternatively, it is also possible to generate the actual intermediate value VM between the positive and negative selecting voltages in the power source circuit 14, and generate the intermediate voltages Vm0 and Vm1 in the scanning circuit 12 so that the intermediate VM can be supplied in accordance with the polarity-inverting signal.

In the figure, the power source circuit 14 is shown as including a voltage generating circuit 141 composed of a DC—DC converter and other components, a resistor division circuit 142, a switching circuit 143, and buffer circuits 144 and 145; preferably, it is further provided with a switching circuit for controlling a power sequence at start-up, and a forced discharge circuit used at shutdown.

In the construction described above, the selecting voltages VH and VL generated in the voltage generating circuit 141 are formed into the signal voltages +Vb and −Vb through resistor division and buffering. The intermediate voltage is theoretically obtained by evaluating the interrelationship between the selecting voltages VH and VL and the signal voltages −Vb and +Vb; actually, however, it is obtained by producing voltages close to the intermediate value VM between the positive and negative selecting voltages, and then exclusively selecting either Vm0 or Vm1 in accordance with the polarity-inverting signal M. In this construction, since one of the resistors r in the resistor division circuit 142 is exclusively short-circuited by the switching circuit 143, and since the resistance of the resistors r is lower than other resistors R1 and R2, the output of the resistor division circuit 142 is free from voltage variation.

The magnitudes of these selecting voltages and signal voltages are calculated according to the amplitude selection scheme. For example, for the driving with a duty ratio of 1/240, the optimum bias value is 1:16.5, which means signal voltages of +1.8 V relative to selecting voltages of 30 V. However, these voltage values are expressed only on the assumption that the intermediate value VM between the positive and negative selecting voltages is zero volt, that is, the so-called direct-current level does not necessarily need to be equal to the intermediate value VM between the positive and negative selecting voltages. In this sense, therefore, the terms "positive" and "negative" appearing in this specification only require that the two selecting voltages have opposite polarities to each other with respect to a non-selecting voltage. As the result of this interrelationship among voltages, scanning and driving are achieved with the waveforms as shown in FIG. 2A, and the voltages applied to the liquid crystal look as shown in FIG. 2C. As seen from these figures, the scanning voltage results from selecting either the positive or negative selecting voltage VH or VL at constant time intervals; however, the polarity-inverting signal M does not necessarily have the same time interval as the frame-to-frame period. Further, since the signal voltage outputted from the signal circuit 13 depends on which voltage is selected, +Vb or −Vb, according as the video signal and the polarity-inverting signal M change, the voltages in both cases are simultaneously shown in the figures, making the diagrams look like, as it were, beads in an abacus. This does not indicate, however, that both signal voltages may be selected at the same time just as shown in the figure, nor that the voltage waveforms change gradually.

Thus, as the result of deviating the intermediate voltage Vm from the intermediate value VM between the positive and negative selecting voltages, two intermediate voltages are selectively used in this method. This method is based on the results of an experiment which proved this method to be effective in eliminating ghosts. The reasons are not clear, but are supposed to be as described below.

Because of higher scanning voltages and lower signal voltages, the integrated circuit in the scanning circuit 12 needs to have an output stage that can handle voltages approximately twice as high as in conventional devices. However, the processing here requires only slow processing speeds which depends on the number of the scanning lines. Moreover, since one of the three potentials is selected in the output stage, the switching of the polarity-inverting signal does not cause a large current. Further, deformation of waveforms, which have been causing cross talk in conventional devices, rarely occurs. On the other hand, the signal circuit 13 can be driven with a voltage as low as 5 V in the above example, realizing high-speed driving with ease. As a result, compared with a conventional device that is driven by alternately using the scanning and signal voltages, the device is intrinsically far less susceptible to ghosts.

However, when a larger liquid crystal cell 11 is used, or when the video signal draws certain patterns, the device shows some partial faults in display such as ghosts as mentioned earlier, although it does not go so far as to cause serious degradation of display quality by, for example, lowering contrast. The probable reason for this problem is that the power supplied from the power supply unit does not properly respond to large changes in the currents owing to the picture elements or the scanning lines. Accordingly, in order to reinforce the supply of bias currents, the buffers 144 and 145 are reconstructed with operational amplifiers having feedback circuits. In the liquid display device of this embodiment, where large-value positive and negative voltages are prepared beforehand and used as the scanning voltage, the reconstruction of the buffer 145 for the non-selecting voltage (VM) is not effective enough, whereas the reconstruction of the buffer 144 for the signal voltage, realized by providing it with a feedback circuit composed of a differentiating circuit that compensates for consumed currents, was effective enough to make observable how the shadows extending rightward and leftward from around a black bar displayed on the device change in accordance with the amount of feedback.

Still, however, the device sometimes shows cross talk when it displays bars of different widths in different positions or when it displays features other than bars. The probable reason for this problem is that the liquid crystal cell 11 has asymmetrical characteristics against positive and negative voltages; this may result from the electrode groups having different electrode capacitances from each other due to a color filter provided on only one of them to achieve display in color, or result from changes in dielectric constant distribution due to alignment of liquid crystal molecules. Based on these assumptions, a further examination as to the period of the polarity-inverting signal and the positive-negative balance of the applied voltages has led to the present invention, which use intermediate voltages that are slightly deviated from the theoretical value. Thus, the present invention has allowed to observe how ghosts appearing on the screen change from white ghosts to no ghosts, and then to black ghosts depending on how much the intermediate voltage deviates from the intermediate value VM.

Further, the liquid crystal display device of this embodiment has also revealed that, even though the deviation of the intermediate voltage Vm from the intermediate value VM between the positive and negative selecting voltages is very small, e.g. 0.17 V for 450×1,440 dots, and 0.09 V for 480×1,860 dots, the amount of this deviation greatly affects how clearly ghosts appear. Further, it has also revealed that the two intermediate voltages Vm0 and Vm1 are preferably determined so that they are arranged symmetrically with respect to the intermediate value VM between the positive and negative selecting voltages. This means that the two resistors r in FIG. 1 should have the same resistance, and more preferably, should allow device-by-device fine-tuning.

Figure 3:
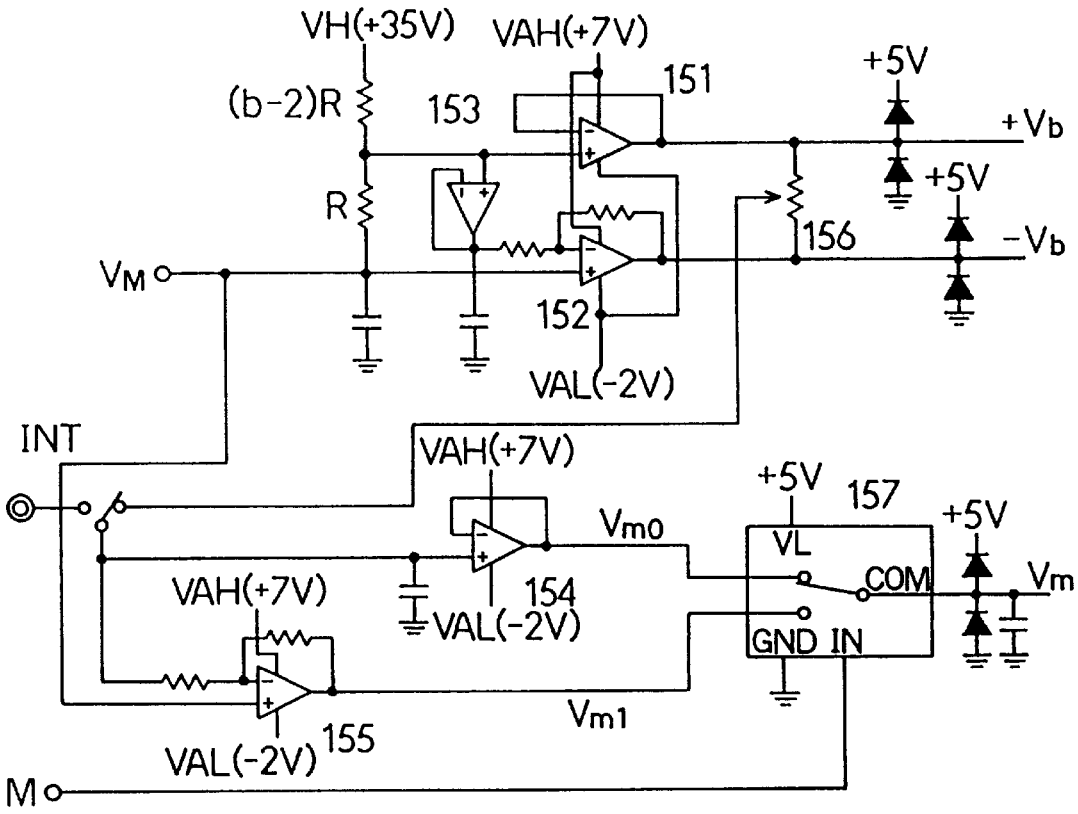
FIG. 3 is a circuit diagram of the principal part of the power supply circuit of the first embodiment of the present invention.

FIG. 3 is a circuit diagram of the principal part of the power supply circuit for this purpose. The operational amplifiers 151 and 152 produce the signal voltages +Vb and −Vb. Specifically, one signal voltage +Vb is obtained by dividing a given voltage, for example, with resistors; the other signal voltage −Vb is obtained by inverting the one signal voltage +Vb with respect to the intermediate value VM (in FIG. 3, the absolute voltage is TTL/2=2.5 V) between the positive and negative selecting voltages. The buffer 153 at the input of the operational amplifier 152 is provided in order to prevent voltage variation.

The operational amplifiers 154 and 155 produce the intermediate voltages Vm0 and Vm1. Specifically, one intermediate voltage Vm0 is obtained either from a variable resistor 156 provided between the signal voltages +Vb and −Vb or as a compensation signal INT that is supplied based on a compensation voltage calculated in accordance with a video signal; the other intermediate voltage Vm1 is obtained by producing a voltage that is symmetrical with the one intermediate voltage Vm0 with respect to the intermediate value VM between the positive and negative selecting voltages. By means of the variable resistor 156, the intermediate voltage Vm can be set to any value between the two signal voltages. Actually, however, since displaying itself is impossible if an intermediate voltage is too close to one of the signal voltages, the intermediate voltage is effective when it is within a range of 10%, or more practically 0.1 to 5%, of the signal voltage relative to the intermediate value between the signal values. The switch 157 is an analog switch for exclusively selecting either the intermediate voltages Vm0 or Vm1, and it uses the polarity-inverting signal M to perform selection, as in the example described earlier. As the result of this construction, it is possible to obtain, by means of the variable resistor 156, intermediate voltages Vm that are symmetrically arranged close to the intermediate value VM between the positive and negative selecting voltages and that can be adapted to every individual liquid crystal module.

As described above, in the liquid crystal display device of this embodiment, the scanning circuit uses positive and negative selecting voltages as the scanning voltage, and it uses two signal voltages that are close to the intermediate value between the selecting voltages in accordance with the video signal. This enables the signal circuit to process the video signal fast enough, with ease, and at a low voltage even when the video signal contains a greatly increased amount of information. Moreover, although the scanning circuit and the signal circuit need to handle different ranges of voltages and the selecting voltages need to have large values, those selecting voltages having large values are generated and applied only sequentially according to a prescribed sequence or at prescribed intervals. This prevents the integrated circuits from being driven into malfunction or runaway, and prevents those voltages from being kept applied to the liquid crystal.

In addition, even in the case where the scanning circuit and the signal circuit have to handle different ranges of voltages as described above, it is possible to effectively control ghosts, which are associated with the simple matrix driving, without degrading excellent display quality.

Figure 4:
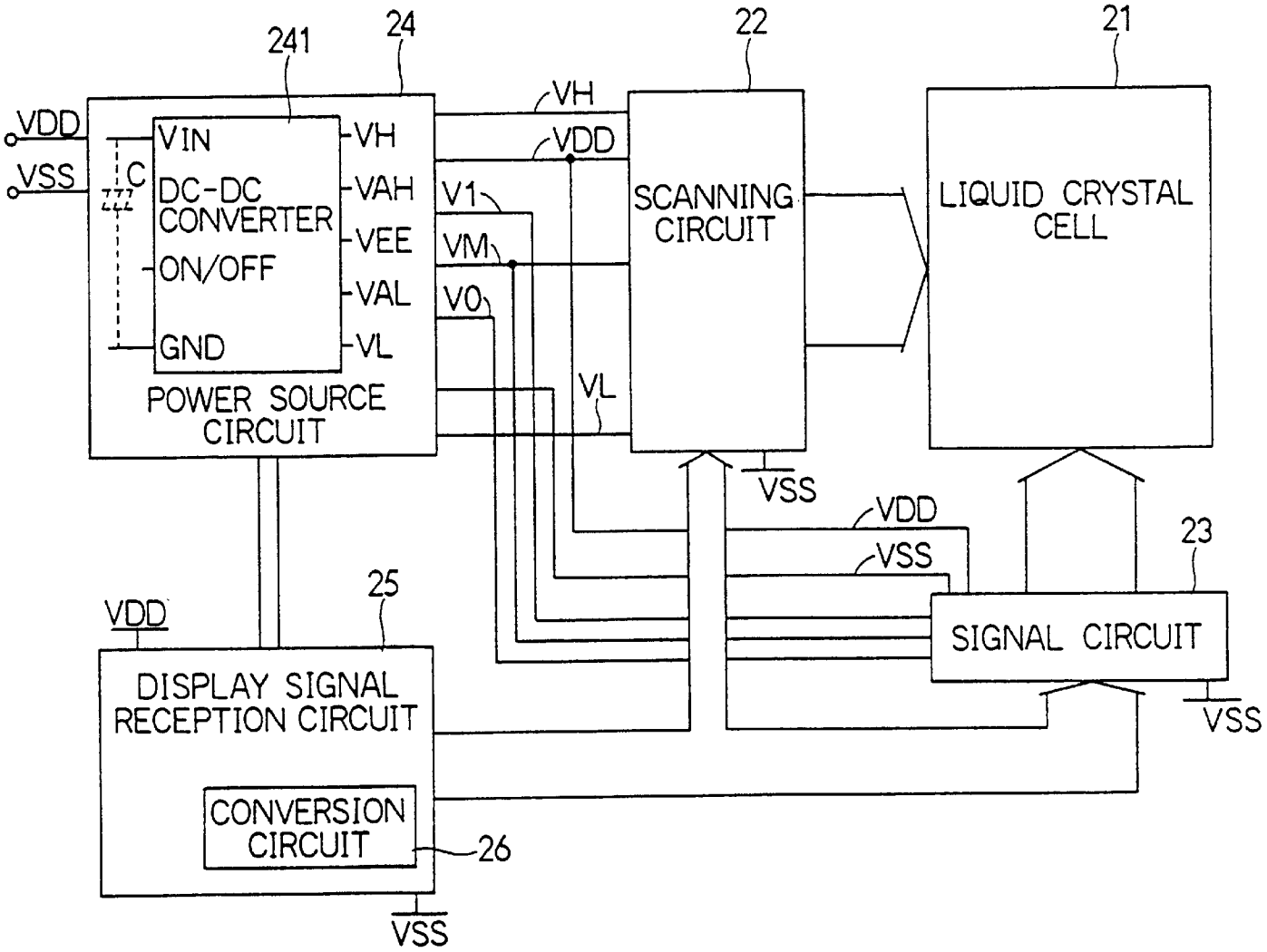
FIG. 4 is a block diagram of a liquid crystal display device of a second embodiment of the present invention.

Hereinafter, a second embodiment of the present invention will be described with reference to the drawings. FIG. 4 is a block diagram of a liquid crystal display device of this embodiment. Reference numeral 21 represents a liquid crystal cell provided with electrode groups that are arranged perpendicularly to each other on both sides of a liquid crystal layer. Used as the liquid crystal cell 21 is, for example, a field-effect-type liquid crystal such as a super-twisted nematic liquid crystal display device. The electrodes of the liquid crystal cell 21 form the so-called simple matrix, which does not have active devices like transistors at the intersections of the electrodes, that is, at the picture elements. Reference numeral 22 represents a scanning circuit for supplying a scanning voltage to one electrode group of the liquid crystal cell 21; it selects one from among a positive voltage VH (+30 to +20 V), a negative voltage VL (−25 to −15 V), and an intermediate voltage VM (around +2.5 V), and supplies it to a specific electrode. Of the three voltages mentioned, VH and VL are the selecting voltages. For the intermediate voltage, as described in the first embodiment, it is more preferable to use voltages Vm0 and Vm1 which are a little different from the intermediate value VM between the positive and negative selecting voltages VH and VL. Reference numeral 23 represents a signal circuit for supplying the other electrode group of the liquid crystal cell 21 with a voltage in accordance with a video signal; more specifically, it supplies those electrodes with either of two types of difference voltages V1 (+2.5 to +4.5 V) and V0 (+0.5 to +2.5 V), which are both close to the intermediate value between the positive and negative selecting voltages VH and VL of the scanning circuit 22, in accordance with the video signal. For example, for the driving with a duty ratio of 1/240, the optimum bias value is 1:16.5, which means difference voltages of 4.3 V and 0.7 V relative to selecting voltages of 30 V. The scanning circuit 22 and the signal circuit 23 are composed of integrated circuits that operate with a power source voltage VDD of +3 to +5 V.

Reference numeral 24 is a power source circuit which receives the power source voltage VDD (VSS: 0 V, VDD: +3 to +5 V) as a direct-current power source from an external device, and which supplies voltages having predetermined bias values to the scanning circuit 22 and the signal circuit 23. The power source circuit 24 is provided with a DC—DC converter 241 for converting a direct-current power source voltage supplied from the outside device into higher and lower voltages, a resistor division circuit for producing output voltages having predetermined values, and other circuits. The power source circuit 24 produces at least the positive and negative selecting voltages VH and VL, the difference voltages V1 and V0, and the intermediate voltage VM; more preferably, it also supplies a logic-circuitry power source voltage VDD (+3 to +5 V) to the scanning circuit 22 and the signal circuit 23, and a bias voltage VEE (around +5 V) to the signal circuit 23.

Figure 7:
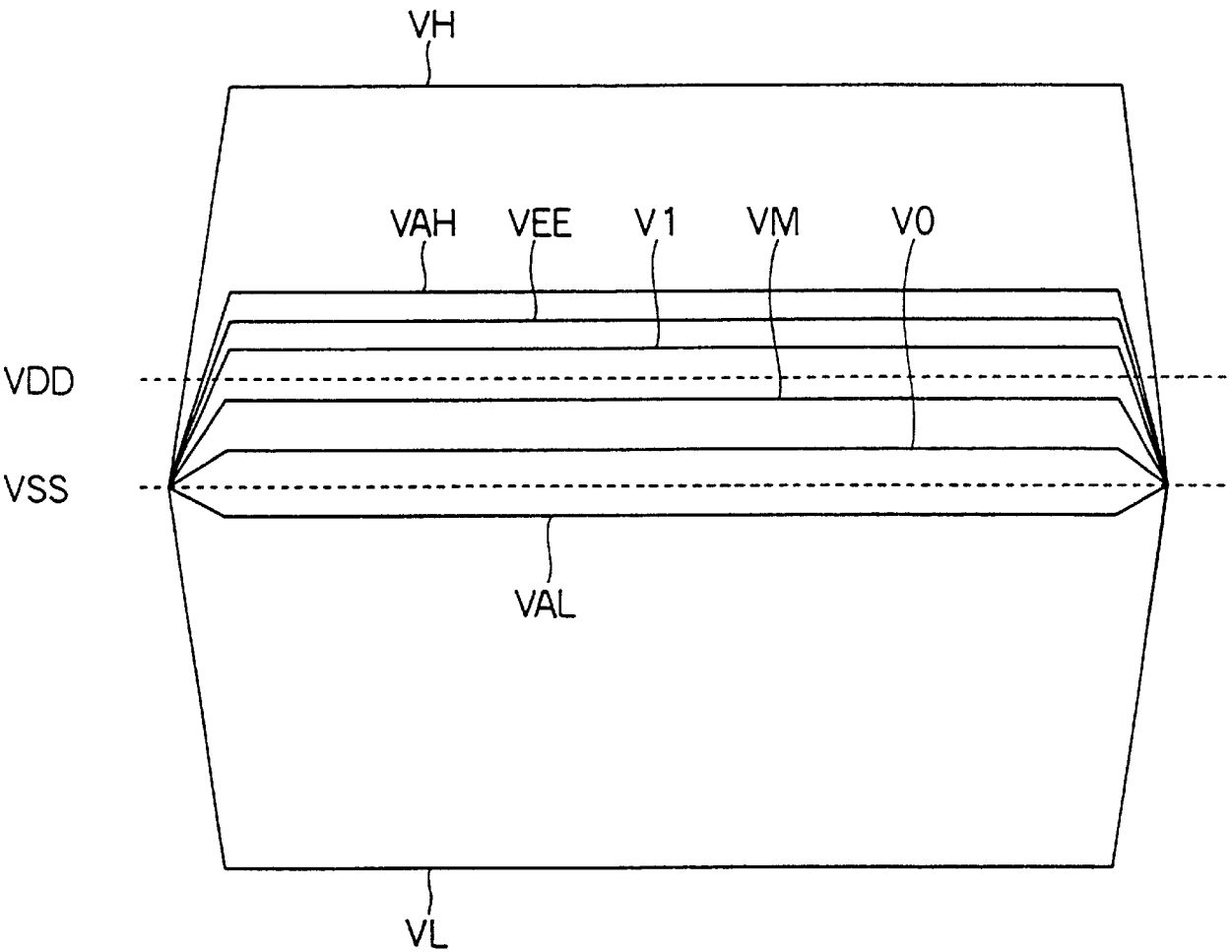
FIG. 7 is a time chart showing voltages of the second embodiment of the present invention.

FIG. 7 shows the interrelationship between the above-mentioned voltages. The figure shows the case where all the voltages are produced from the supplied power source voltage (VSS: 0 V, VDD: +3 V), and where the level of the supplied voltage is used untouched as the logic-circuitry power source voltage VDD for the scanning circuit 22 and the signal circuit 23. On the other hand, the DC—DC converter 241, using the zero-volt line (VSS) as a reference voltage, produces the positive and negative selecting voltages VH and VL, the power sources VAH (around +7 V) and VAL (around −2 V) for circuit devices such as operational amplifiers, and a bias voltage VEE (around +5 V). The intermediate voltage VM is obtained by evaluating the interrelationship between these selecting voltages VH and VL and the difference voltages V1 and V0. The magnitudes of these selecting voltages and difference voltages are calculated according to the amplitude selection scheme.

Reference numeral 25 represents a display signal reception circuit which receives a display signal (including display control signals and a video signal) from an external device such as a personal computer, and processes the received signal in a predetermined way for output. The display signal reception circuit 25 includes, in addition to buffer circuits (not shown in the figure) for each signal, a conversion circuit 26 as shown in FIG. 5.

Figure 5:
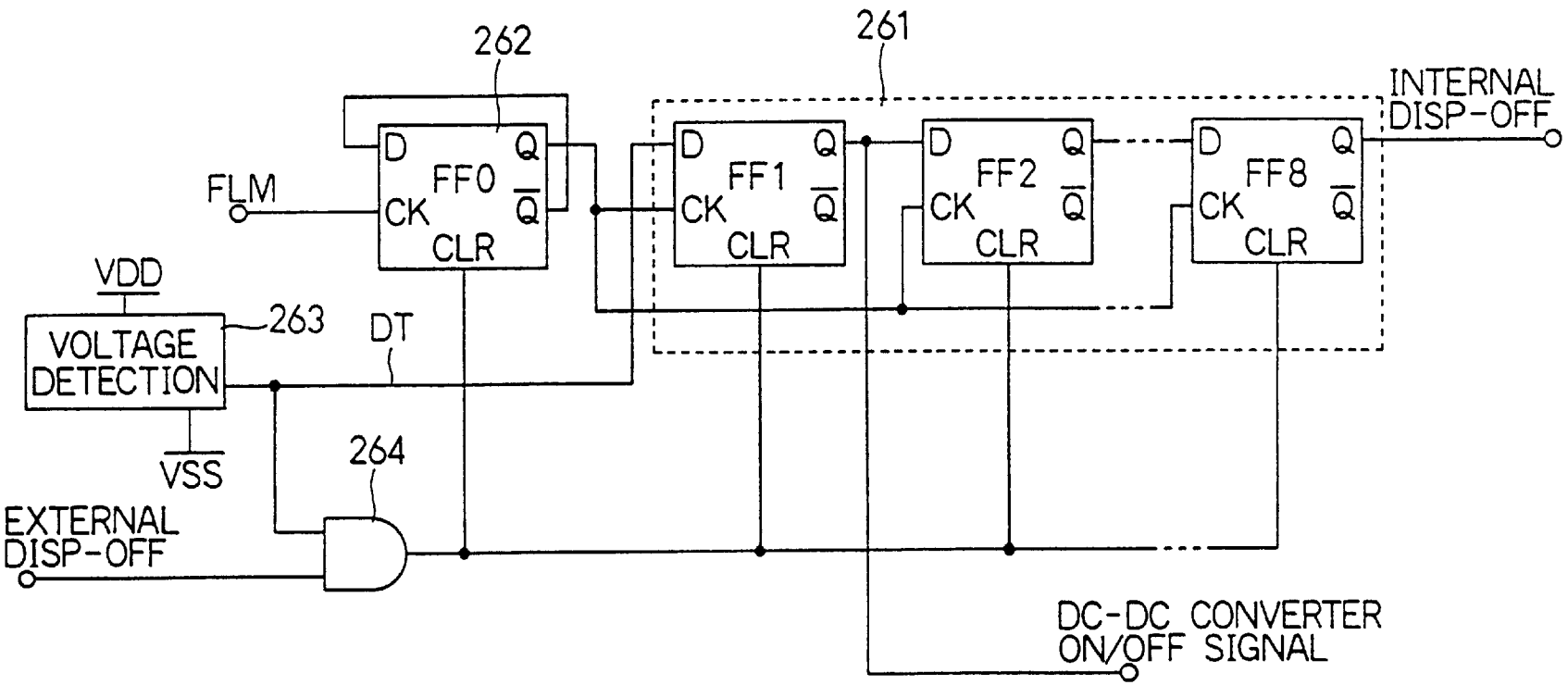
FIG. 5 is a circuit diagram of the conversion circuit of the second embodiment of the present invention.

The conversion circuit 26 is, as shown in FIG. 5, provided with a delay circuit 261 formed from shift registers composed of a plurality of, e.g. eight, flip-flops (FF1 to FF8); a clock circuit 262 for supplying a clock pulse for shifting to the shift registers, composed of a flip-flop (FF0) that has its clock terminal (CK) connected to the frame (FLM) signal and its data terminal (D) connected to the inverted output so as to divide a pulse-like signal, preferably the frame (FLM) signal (60 Hz), supplied as one of the display control signals from the external device; a voltage detection circuit 263 for outputting a detection signal (DT) on detecting the power source voltage VDD having risen to a predetermined value (around +2.5 V); an initializing circuit 264 composed of an AND gate for generating a signal for initializing the delay circuit 261; and other circuits. Supplied to the input terminal of the initializing circuit 264 are the output (DT) of the voltage detection circuit 263, and a display-activating (external DISP-OFF) signal that the external device delivers as one of the display control signals to turn on and off the display. The output of the initializing circuit 264 is connected to the clear (CLR) terminal of each flip-flop (FF1 to FF8) composing the delay circuit 261, so that the delay circuit 261 is kept in the initial state when the power source voltage VDD is below the predetermined value or when the external DISP-OFF is in the inactive state (L-level).

The input terminal of the delay circuit 261, that is, the data (D) terminal of the first-stage flip-flop FF1 is supplied with the output (DT) of the voltage detection circuit 263. The output of one of the stages comprising the delay circuit 261, most preferably the output terminal (Q) of the first stage FF1, is connected to the ON/OFF terminal of the DC—DC converter 241 so that the DC—DC converter 241 can be controlled. The delay circuit 261 sets a delay time T2 (e.g. 112 ms) based on the number of flip-flops composing itself and based on the pulse period of the clock circuit 262 so that the delay time T2 will be longer than the delay time T1 (e.g. 40 to 50 ms) which every output voltage of the DC—DC converter 241 takes to rise to its determined voltage.

Figure 6:
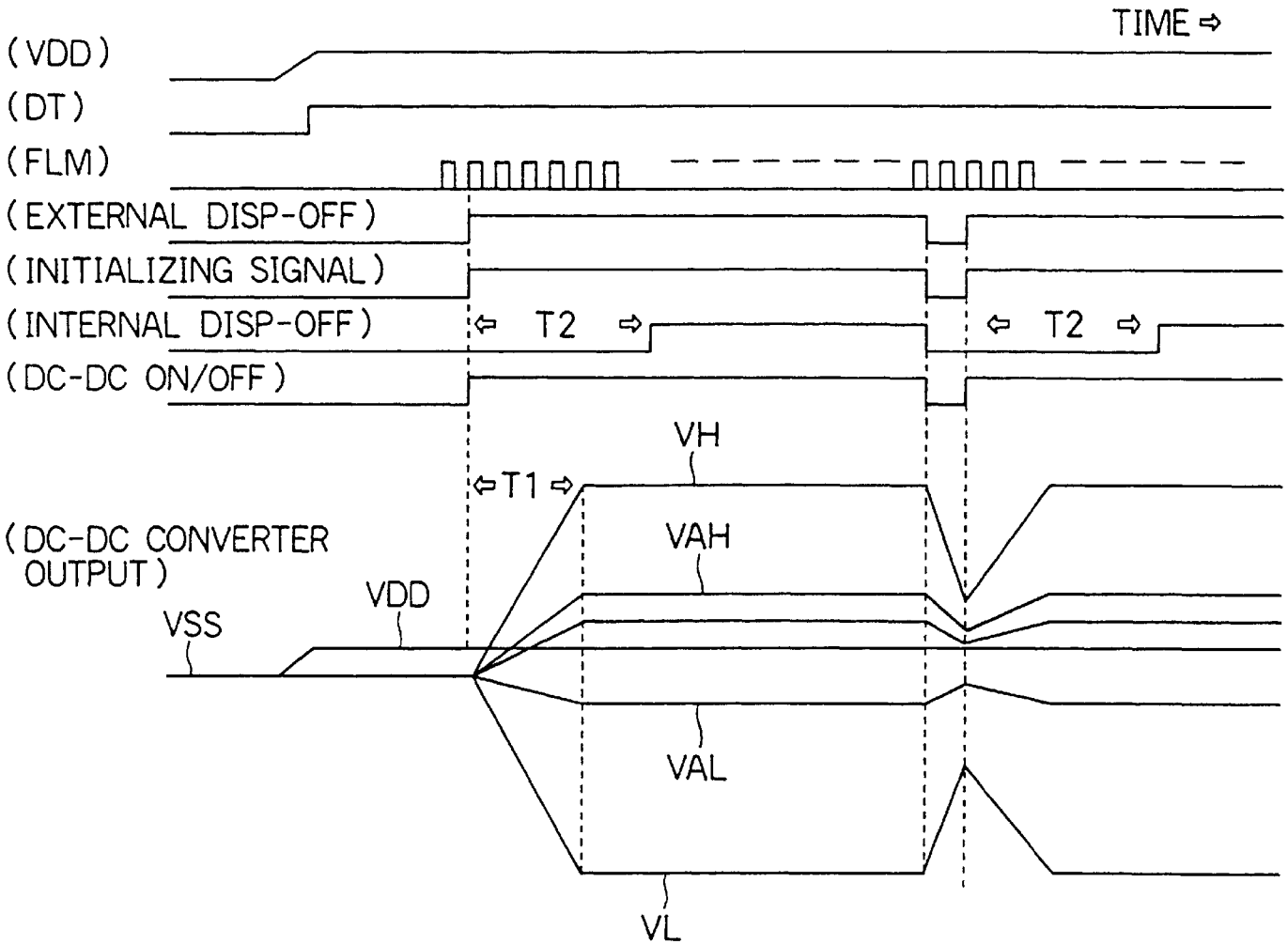
FIG. 6 is a time chart showing voltages and signals of the second embodiment of the present invention.

The operation of the above described construction will be described below with reference to FIGS. 4 to 6. When the external device, according to its display-on sequence, starts the supply of the power source voltage VDD and the display signals to the liquid crystal display device, the power source voltage VDD rises to the determined voltage, the voltage detection circuit 263, on detecting the power source voltage VDD, supplies a detection signal (DT) to the delay circuit 261, and the clock circuit 262, on receiving the FLM signal, starts generating a predetermined clock pulse. Here, until the detection signal (DT) that is outputted by the voltage detection circuit 263 depending on the state of the power source voltage VDD and the external DISP-OFF signal both become H-level, the delay circuit 261 is kept in the initial state by the output of the initializing circuit 264, and accordingly the internal DISP-OFF signal outputted from the delay circuit 261 is kept in the inactive (L-level) state. While the internal DISP-OFF signal is kept in the inactive (L-level) state, the scanning circuit 22 and the signal circuit 23 are kept in the inactive states.

When the output of the initializing circuit 264 turns H-level, the delay circuit 261 starts operating, with its FF1 simultaneously supplying an ON signal to the DC—DC converter 241. Thus the DC—DC converter 241 starts operating, and, in the course of the time T1, every bias voltage reaches the predetermined voltage. In the course of the time T2 that follows the lapse of the time T1, the internal DISP-OFF signal outputted from the delay circuit 261 turns into the active state (H-level). When this internal DISP-OFF signal is delivered to the scanning circuit 22 and the signal circuit 23, these circuits are activated and start driving the liquid crystal. At this time point, since the scanning circuit 22 and the signal circuit 23 are already supplied with the determined bias voltages, they can immediately start displaying on the liquid crystal cell.

In the normal state after the completion of the display-on sequence, if the external device holds the external DISP-OFF signal at L-level for a short while, for example, to check the VRAM, the initializing circuit 264, in response to this change of the external DISP-OFF signal, initializes the delay circuit 261. This initialization causes an OFF signal to be supplied to the DC—DC converter 241 for a short while, with the result that the DC—DC converter 241 halts its operation for a moment and then restarts operation. Thus, it takes the predetermined time again for the output voltages to reach the predetermined voltages. Nevertheless, the delay circuit 261 keeps the internal DISP-OFF signal in the inactive state (L-level) for a longer time T2 than the time taken by the output voltages to restore their predetermined voltages, and accordingly the scanning circuit 22 and the signal circuit 23 are kept inactive during that time. As a result, it is possible to eliminate degradation of display quality due to the untimely activation of the scanning circuit 22 and the signal circuit 23 before the bias voltages fully rise to the predetermined values.

The external DISP-OFF signal can also be used to inactivate the DC—DC converter 241; this prevents the liquid crystal cell 21 from being damaged by residual charge. Specifically, in the display-off sequence, when the external device turns the DISP-OFF signal into the inactive state (L-level) at a certain desired time point, e.g. just before the power source voltage VDD is let down, the delay circuit 261 turns into the initial state, changing the output of its first stage FF1 to L-level. This level change is delivered to the ON/OFF terminal of the DC—DC converter 241, which then stops its operation. Thus, the bias voltages for driving the liquid crystal are turned off before the power source voltage VDD is turned off, with the result that the liquid crystal cell 21 is protected against damage due to residual charge.

If the supply of the power source voltage VDD is cut before the external DISP-OFF signal is turned into the inactive stage (L-level), the voltage detection circuit 263 detects the drop of the power source voltage VDD, and, in response to its output, the initializing circuit 264 initializes the delay circuit 261. This initialization not only stops the operation of the DC—DC converter 241, but also inactivates the scanning circuit 22 and the signal circuit 23. Here, in order to make the power source voltage VDD take a longer time to fall down during, for example, the display-off sequence, it is desirable to provide a capacitor C across the power source input terminals of the DC—DC converter 241.

The voltages outputted from the scanning circuit 22 and the signal circuit 23 and the voltage applied to the liquid crystal cell 21 according to the above-mentioned construction are similar to those shown in FIGS. 8A and 8B. When two voltages Vm0 and Vm1 which are a little different from the intermediate voltage VM are employed instead of the voltage VM like in the first embodiment, the voltage applied to the liquid crystal cell 21 is similar to that shown in FIGS. 2A to 2C, which is more preferable to improve the display quality.

As described above, in the liquid crystal display device of this embodiment, during the display-on sequence or in the normal display state, the scanning circuit and the signal circuit can be kept in the inactive state until the bias voltages for driving the liquid crystal rise to the predetermined voltages. As a result, it is possible to prevent the screen from being disturbed with stripes, and to eliminate degradation of the display quality, such as the gradual lighting up of the screen.

Moreover, in the liquid crystal display device of this embodiment, the bias voltages for driving the liquid crystal can be turned off by a display-activating signal provided from the outside. As a result, it is possible to turn off the bias voltages for driving the liquid crystal before the supplied power source voltage is turned off even if the supplied power source voltage is low and accordingly it is quick to fall down.

Obviously, many modifications and variations of the present invention are possible in light of the above teachings. It is therefore to be understood that within the scope of the appended claims, the invention may be practiced other than as specifically described.

What is claimed is:

1. A liquid crystal display device comprising:

a liquid crystal cell having electrode groups arranged perpendicularly to each other;

a scanning circuit for selectively supplying a large positive voltage and a large negative voltage alternately at constant time intervals as a scanning signal to one electrode group of said liquid crystal cell and for supplying thereto a small negative voltage slightly deviated from an intermediate value between the large positive voltage and the large negative voltage and a small positive voltage slightly deviated from the intermediate value; and a signal circuit for selectively supplying signal voltages that are close to the intermediate value to another electrode group of the liquid crystal cell in accordance with a video signal.

2. The liquid crystal display device of claim 1, wherein the scanning circuit supplies the large positive voltage and the small negative voltage during one period and the large negative voltage and the small positive voltage during another period.

* * * * *